US010297272B2

(12) United States Patent
Elshamy et al.

(10) Patent No.: US 10,297,272 B2
(45) Date of Patent: May 21, 2019

(54) SIGNAL PROCESSOR

(71) Applicant: NXP B.V., Eindhoven (NL)

(72) Inventors: Samy Elshamy, Braunschweig (DE); Tim Fingscheidt, Braunschweig (DE); Nilesh Madhu, Kessel-Lo (BE); Wouter Joos Tirry, Wijgmaal (BE)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/497,805

(22) Filed: Apr. 26, 2017

(65) Prior Publication Data

US 2017/0323656 A1 Nov. 9, 2017

(30) Foreign Application Priority Data

May 6, 2016 (EP) ..... 16168643

(51) Int. Cl.
*G10L 25/24* (2013.01)
*G10L 25/90* (2013.01)
(Continued)

(52) U.S. Cl.
CPC ..... *G10L 25/24* (2013.01); *G10L 21/0364* (2013.01); *G10L 25/90* (2013.01); *G10L 21/0208* (2013.01)

(58) Field of Classification Search
CPC ..... G10L 15/24
See application file for complete search history.

(56) References Cited

U.S. PATENT DOCUMENTS 6,691,090 B1 * 2/2004 Laurila ..... G10L 15/02 704/205
6,993,483 B1 * 1/2006 Milner ..... G10L 15/30 704/236

(Continued)

FOREIGN PATENT DOCUMENTS

| | | |
|---|---|---|
| EP | 0 637 012 A2 | 1/1995 |
| EP | 0 637 012 A3 | 1/1995 |
| WO | WO-97/37345 A1 | 10/1997 |

OTHER PUBLICATIONS

Zhu, Qifeng, and Abeer Alwan. "Non-linear feature extraction for robust speech recognition in stationary and non-stationary noise." Computer speech & language 17.4 (2003): 381-402.*

(Continued)

*Primary Examiner* — Douglas Godbold

(57) ABSTRACT

A signal processor comprising:
a signal-manipulation-block configured to:
receive a cepstrum-input-signal, wherein the cepstrum-input-signal is in the cepstrum domain and comprises a plurality of bins;
receive a pitch-bin-identifier that is indicative of a pitch-bin in the cepstrum-input-signal; and
generate a cepstrum-output-signal based on the cepstrum-input-signal by:
scaling the pitch-bin relative to one or more of the other bins of the cepstrum-input-signal; or
determining an output-pitch-bin-value based on the pitch-bin, and setting one or more of the other bins of the cepstrum-input-signal to a predefined value; or
determining an output-other-bin-value based on one or more of the other bins of the cepstrum-input-signal, and setting the pitch-bin to a predefined value.

13 Claims, 4 Drawing Sheets

(51) Int. Cl.
*G10L 21/0364* (2013.01)
*G10L 21/0208* (2013.01)

(56) References Cited

U.S. PATENT DOCUMENTS

2008/0234959 A1* 9/2008 Joublin ..... G10L 25/90
702/75
2009/0210224 A1* 8/2009 Fukuda ..... G10L 15/02
704/233
2013/0253920 A1* 9/2013 Lin ..... G10L 17/20
704/204
2014/0046658 A1* 2/2014 Grancharov ..... G10L 25/78
704/208

OTHER PUBLICATIONS

Fodor, Balázs et al; "A Posteriori Speech Presence Probability Estimation Based on Averaged Observations and a Super-Gaussian Speech Model"; Proc. of IEEE IWAENC, Antibes—Juan-les-Pins, France; pp. 11-15 (Sep. 2014).
Breithaupt, Colin et al; "A Novel a Priori SNR Estimation Approach Based on Selective Cepstro-Temporal Smoothing"; Proc. of IEEE ICASSP. Las Vegas, NV, USA; pp. 4897-4900 (Mar. 2008).
Plapous, Cyril et al; "Improved Signal-to-Noise Ratio Estimation for Speech Enhancement," IEEE Transactions on Audio Speech and Language Processing, vol. 14, No. 6; pp. 2098-2108 (Nov. 2006).
Sohn, Jongseo; "A Statistical Model-Based Voice Activity Detection"; IEEE Signal Processing Letters, vol. 6, No. 1; pp. 1-3 (Jan. 1999).
Krini, Mohamed et al; "Model-Based Speech Enhancement; Speech and Audio Processing in Adverse Environments"; Eberhard Hänsler and Gerhard Schmidt (eds.), Springer Berlin Heidelberg; pp. 89-134 (2008).
Martin, Raunerl "Noise Power Spectral Density Estimation Based on Optimal Smoothing and Minimum Statistics," IEEE Transactions on Speech and Audio Processing, vol. 9, No. 5; pp. 504-512 (Jul. 2001).
Gerkmann, Timo et al; "Improved a Posteriori Speech Presence Probability Estimation Based on a Likelihood Ratio with Fixed Priors," IEEE Transactions on Audio Speech and Language Processing, vol. 16, No. 5; pp. 910-919 (Jul. 2008).
Ephraim, Yariv et al; "Speech Enhancement Using a Minimum Mean-Square Error Short-Time Spectral Amplitude Estimator"; IEEE Transactions on Acoustics Speech and Signal Processing, vol. ASSP-32, No. 6; pp. 1109-1121 (Dec. 1984).
Ephraim, Yariv et al; "Speech Enhancement Using a Minimum Mean-Square Error Log-Spectral Amplitude Estimator"; IEEE Transactions on Acoustics Speech and Signal Processing, vol. ASSP-33, No. 2; pp. 443-445 (Apr. 1985).
Breithaupt, Colin et al; "Cepstral Smoothing of Spectral Filter Gains for Speech Enhancement Without Musical Noise"; IEEE Signal Processing Letters, IEEE Service Center, Piscataway, NJ, US, vol. 14, No. 12: pp. 1036-1039 (Dec. 1, 2007).

* cited by examiner

SIGNAL PROCESSOR

CROSS-REFERENCE TO RELATED APPLICATIONS

This application claims the priority under 35 U.S.C. § 119 of European patent application no. 16168643.1, filed May 6, 2016 the contents of which are incorporated by reference herein.

The present disclosure relates to signal processors, and in particular, although not exclusively, to signal processors that can reduce noise in speech signals.

According to a first aspect of the present disclosure there is provided a signal processor comprising:

a signal-manipulation-block configured to:

receive a capstrum-input-signal, wherein the cepstrum-input-signal is in the cepstrum domain and comprises a plurality of bins;

receive a pitch-bin-identifier that is indicative of a pitch-bin in the cepstrum-input-signal; and generate a cepstrum-output-signal based on the cepstrum-input-signal by:

scaling the pitch-bin relative to one or more of the other bins of the cepstrum-input-signal; or determining an output-pitch-bin-value based on the pitch-bin, and setting one or more of the other bins of the cepstrum-input-signal to a predefined value; or determining an output-other-bin-value based on one or more of the other bins of the cepstrum-input-signal, and setting the pitch-bin to a predefined value.

In one or more embodiments the signal-manipulation-block is configured to generate the cepstrum-output-signal by determining an output-zeroth-bin-value based on a zeroth-bin of the cepstrum-input-signal.

In one or more embodiments the signal-manipulation-block is configured to scale the pitch-bin relative to one or more of the other bins of the cepstrum-input-signal by:

applying a pitch-bin-scaling-factor to the pitch-bin of the cepstrum-input-signal; and applying an other-bin-scaling-factor to one or more of the other bins of the cepstrum-input-signal; wherein the other-bin-scaling-factor is different to the pitch-bin-scaling-factor.

In one or more embodiments the signal-manipulation-block is configured to scale the pitch-bin relative to one or more of the other bins of the cepstrum-input-signal by.

applying a pitch-bin-scaling-offset to the pitch-bin of the cepstrum-input-signal; and applying an other-bin-scaling-offset to one or more of the other bins of the cepstrum-input-signal; wherein the other-bin-scaling-offset is different to the pitch-bin-scaling-offset.

One or more of the other-bin-scaling-offsets and/or the pitch-bin-scaling-offset may be equal to zero.

In one or more embodiments the pitch-bin-identifier is indicative of a plurality of pitch-bins, which may be representative of a fundamental frequency.

The other-bin-scaling-factor may be less than the pitch-bin-scaling-factor (e.g. to emphasise the pitch). The other-bin-scaling-factor may be greater than the pitch-bin-scaling-factor (e.g. to de-emphasise the pitch). The pitch-bin-scaling-factor may be greater than or equal to one (this will make the pitch more pronounced). The pitch-bin-scaling-factor may be less than or equal to one (this will de-emphasise the pitch). The other-bin-scaling-factor may be less than or equal to one (to de-emphasise the other parts of the signal other than the pitch). The other-bin-scaling-factor may be greater than or equal to one (to emphasise the other parts of the signal).

For similar reasons as above, the other-bin-scaling-offset may be less than the pitch-bin-scaling-offset. The other-bin-scaling-offset may be greater than the pitch-bin-scaling-offset. The pitch-bin-scaling-offset may be greater than or equal to zero. The pitch-bin-scaling-offset may be less than or equal to zero. The other-bin-scaling-offset may be less than or equal to zero. The other-bin-scaling-offset may be greater than or equal to zero.

In one or more embodiments the cepstrum-Input-signal is representative of a speech signal or a noise signal.

In one or more embodiments the signal-manipulation-block is configured to generate the cepstrum-output-signal by setting the amplitude of one or more of the other bins of the cepstrum-input-signal to zero.

In one or more embodiments the signal processor further comprises a memory configured to store an association between a plurality of pitch-bin-identifiers and a plurality of candidate-cepstral-vectors. Each of the candidate-cepstral-vectors defines a manipulation vector for the cepstrum-input-signal. The signal-manipulation-block may be configured to:

determine a selected-cepstral-vector as the candidate-cepstral-vector that is stored in the memory associated with the received pitch-bin-identifier; and generate the cepstrum-output-signal by applying the selected-cepstral-vector to the cepstrum-input-signal.

The signal-manipulation-block may generate the cepstrum-output-signal by applying the selected-cepstral-vector to the cepstrum-input-signal by:

adding the selected-cepstral-vector (which may include one or more scaling-offset-values) to the cepstrum-input-signal;

multiplying the selected-cepstral-vector (which may include one or more scaling-factor-values) by the cepstrum-input-signal; or replacing one or more values of the cepstrum-input-signal with the selected-cepstral-vector (which may include one or more predefined-values).

The predefined value may be zero or non-zero.

In one or more embodiments the candidate-cepstral-vectors define a manipulation vector that includes predefined other-bin-values for one or more bins of the cepstrum-input-signal that are not the pitch-bin, and optionally not the zeroth bin.

The candidate-cepstral-vectors may define a manipulation vector that includes a zeroth-bin-scaling-factor and/or a pitch-bin-scaling-factor that are less than one, equal to one, or greater than one.

The candidate-cepstral-vectors may define a manipulation vector that includes a zeroth-bin-scaling-offset and/or a pitch-bin-scaling-offset that are less than zero, equal to zero, or greater than zero.

In one or more embodiments the plurality of candidate-cepstral-vectors are associated with speech components from a specific user.

In one or more embodiments the signal processor further comprises:

a pitch-estimation-block configured to:

receive the cepstrum-input-signal;

determine an amplitude of a plurality of the bins in the cepstrum-input-signal; and determine the bin that has the highest amplitude as the pitch-bin.

In one or more embodiments the pitch-estimation-block is configured to determine an amplitude of a plurality of the bins in the cepstrum-input-signal that have a bin-index that is between an upper-cepstral-bin-index and a lower-cepstral-bin-index.

In one or more embodiments the signal processor further comprises:

a frequency-to-cepstrum-block configured to:

receive a frequency-input-signal; and perform a DCTII or DFT on the frequency-input-signal in order to determine the cepstrum-input-signal based on the frequency-Input-signal; and/or a cepstrum-to-frequency-block configured to:

receive the cepstrum-output-signal; and perform an inverse DCTII or an inverse DFT on the cepstrum-output-signal in order to determine a frequency-output-signal based on the cepstrum-output-signal.

In one or more embodiments the signal processor further comprises a sub-harmonic-attenuation-block, configured to attenuate one or more frequency bins in the frequency-output-signal that have a frequency-bin-index that is less than a frequency-domain equivalent of the pitch-bin-identifier in order to generate a sub-harmonic-attenuated-output-signal.

The signal-manipulation-block may be configured to generate the cepstrum-output-signal by setting the amplitude of all bins of the cepstrum-input-signal apart from the zeroth bin and the pitch-bin to zero.

The cepstrum-to-frequency-block may be configured to perform an IDCTII or IDFT on the cepstrum-output-signal.

The signal-manipulation-block may be configured to generate the cepstrum-output-signal by attenuating all bins of the capstrum-input-signal apart from the zeroth bin and the pitch-bin.

There may be provided a method of processing a signal, the method comprising:

receiving a cepstrum-input-signal, wherein the cepstrum-input-signal is in the cepstrum domain and comprises a plurality of bins;

receiving a pitch-bin-identifier that is indicative of a pitch-bin in the cepstrum-Input-signal; and generating a cepstrum-output-signal based on the cepstrum-input-signal by:

scaling the pitch-bin relative to one or more of the other bins of the cepstrum-input-signal; or determining an output-pitch-bin-value based on the pitch-bin, and setting one or more of the other bins of the cepstrum-input-signal to a predefined value; or determining an output-other-bin-value based on one or more of the other bins of the cepstrum-input-signal, and setting the pitch-bin to a predefined value.

There may be provided a speech processing system comprising any signal processor disclosed herein.

There may be provided an electronic device or integrated circuit comprising any signal processor or system disclosed herein, or configured to perform any method disclosed herein.

There may be provided a computer program, which when run on a computer, causes the computer to configure any apparatus, including a processor, circuit, controller, converter, or device disclosed herein or perform any method disclosed herein.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

The above discussion is not intended to represent every example embodiment or every implementation within the scope of the current or future Claim sets. The figures and Detailed Description that follow also exemplify various example embodiments. Various example embodiments may be more completely understood in consideration of the following Detailed Description in connection with the accompanying Drawings.

BRIEF DESCRIPTION OF DRAWINGS

One or more embodiments will now be described by way of example only with reference to the accompanying drawings in which.

DETAILED DESCRIPTION

Telecommunication systems are one of the most important ways for humans to communicate and interact with each other. Whenever speech is transmitted over a channel, channel limitations or adverse acoustic environments at the near end can negatively impact comprehension at the far end (and vice versa) due to, for example, interference captured by the microphone. Therefore, speech enhancement algorithms have been developed for the downlink and the uplink. Such algorithms represent a group of targeted applications for the signal processors disclosed herein. Speech enhancement schemes can compute a gain function generally parameterized by an estimate of the background noise power and an estimate of the so-called a priori Signal-to-Noise-Ratio (SNR).

Figure 1:
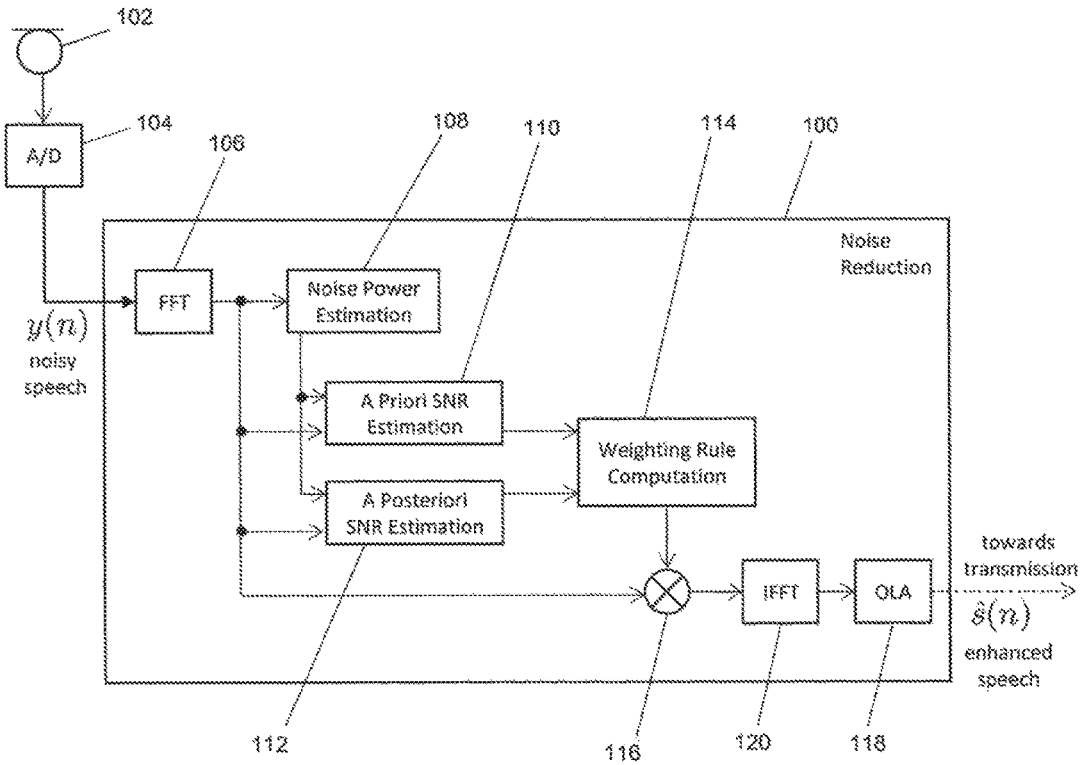
FIG. 1 shows a high-level illustration of a noise reduction system that can be used to provide a speech enhancement scheme.

FIG. 1 shows a high-level illustration of a noise reduction system 100 that can be used to provide a speech enhancement scheme. A microphone 102 captures an audio signal that includes speech and noise. An output terminal of the microphone 102 is connected to an analogue-to-digital converter (ADC) 104, such that the ADC 104 provides an output signal that is a noisy digital speech signal (y(n)) in the time-domain.

The microphone 102 may comprise a single or a plurality of microphones. In some examples, the signals received from a plurality of microphones can be combined into a single (enhanced) microphone signal, which can be further processed in the same way as for a microphone signal from a single microphone.

The noise reduction system 100 includes a fast Fourier transform (FFT) block 106 that converts the noisy digital speech signal (y(n)) into a frequency-domain-noisy-speech-signal, which is in the frequency/spectral domain. This frequency-domain signal is then processed by a noise-power-estimation block 108, which generates a noise-power-estimate-signal that is representative of the power of the noise in the frequency-domain-noisy-speech-signal.

The noise reduction system 100 also includes an a-priori-SNR block 110 and an a-posteriori-SNR block 112. The a-priori-SNR block 110 and the a-posteriori-SNR block 112 both process the frequency-domain-noisy-speech-signal and the noise-power-estimate-signal in order to respectively generate an a-priori-SNR-value and an a-posteriori-SNR-value.

A weighting-computation-block 114 then processes the a-priori-SNR-value and the a-posteriori-SNR-value in order to determine a set of weighting values that should be applied to the frequency-domain-noisy-speech-signal in order to reduce the noise. A mixer 116 then multiplies the set of weighting values by the frequency-domain-noisy-speech-signal in order to provide an enhanced frequency-domain-speech-signal.

The enhanced frequency-domain-speech-signal is then converted back to the time-domain by an inverse fast Fourier transform (IFFT) block 120 and an overlap-add procedure (OLA 118) is applied in order to provide an enhanced speech signal $\hat{s}(n)$ for subsequent processing and then transmission.

The a-priori-SNR-value can have a significant impact on the quality of the enhanced speech signal because it can directly affect suppression gains and can also be accountable for the system's responsiveness in highly dynamic noise environments. False estimation may lead to destroyed harmonics, reverberation effects and other unwanted audible artifacts such as, for example, musical tones, which may impair intelligibility. One or more of the signal processing circuits described below, when applied to an application such as that of FIG. 1, can allow for a better estimate of the a priori SNR, and can achieve an improved preservation of harmonics while reducing audible artifacts.

Figure 2:
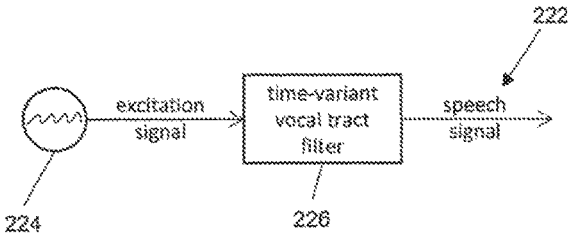
FIG. 2 shows schematically how a human speech signal can be understood.

FIG. 2 shows schematically how a human speech signal can be understood. At a very high level, human speech can be understood as an excitation signal, coming from the lungs and vocal cords 224, processed by a filter representing the human vocal tract 226.

The amplitude response of this filter is termed the spectral envelope. This envelope shapes the excitation signal in order to provide a speech signal 222.

Figure 3:
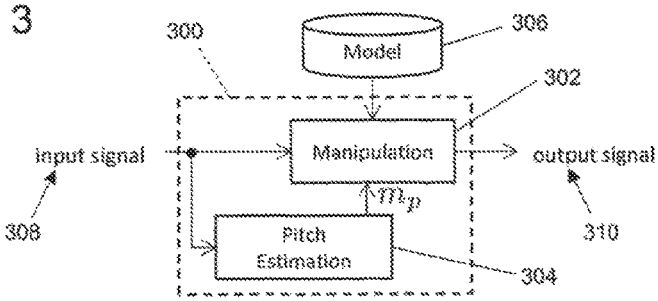
FIG. 3 shows a high level illustration of an example embodiment of an excitation-manipulation-block.

FIG. 3 shows a high level illustration of an example embodiment of an excitation-manipulation-block 300, which includes a signal-manipulation-block 302 and a pitch-estimation-block 304. The signal-manipulation-block 302 and the pitch-estimation-block 304 receive a cepstrum-input-signal 308, which is in the cepstrum domain and comprises a plurality of bins of information. The cepstrum-input-signal 308 is representative of a (noisy) speech signal.

The pitch-estimation-block 304 processes the cepstrum-input-signal 308 and determines a pitch-bin-identifier ($m_p$) that is indicative of a pitch-bin in the cepstrum-input-signal 308. The pitch-estimation-block 304 can receive or determine an amplitude of a plurality of the bins in the cepstrum-input-signal 308 (in some examples all of the bins, and in other examples a subset of all of the bins), and then determine the bin-index that has the highest amplitude as the pitch-bin. The bin-index that has the highest amplitude can be considered as representative of information that relates to the excitation signal. In an alternative embodiment, the pitch-estimation block may determine a set of bin-indices that are related to the pitch, for further processing in the signal-manipulation-block 302. That is, there may be a single pitch-bin or a plurality of pitch-bins. Note that such a plurality of bins do not have to be contiguous.

It will be appreciated that the method of pitch estimation described above is one of several possible implementations.

The signal-manipulation-block 302 can then process the cepstrum-input-signal 308 in accordance with the pitch-bin-identifier ($m_p$) in order to generate a cepstrum-output-signal 310 which, in one example, has reduced noise and enhanced speech harmonics when compared with the cepstrum-input-signal 308. Optionally, the signal-manipulation-block 302 can utilise information relating to a model that is stored in memory 306 when generating the cepstrum-output-signal 310. In another example, the cepstrum-output-signal 310 may have enhanced noise and reduced speech harmonics.

As will be discussed in detail below, using a signal-manipulation-block 302 that processes signals in the cepstrum domain can provide advantages in terms of an ability to emphasize or de-emphasize portions of a received signal that relate to speech. The signal-manipulation-block 302 can generate the cepstrum-output-signal 310 by scaling the pitch-bin of the cepstrum-input-signal 308 relative to one or more of the other bins of the cepstrum-input-signal 308. This can involve applying unequal scaling-factors or scaling-offsets. Alternatively, the signal-manipulation-block 302 can generate the cepstrum-output-signal 310 by either: (i) determining an output-pitch-bin-value based on the pitch-bin in the cepstrum-input-signal 308, and setting one or more of the other bins of the cepstrum-input-signal to a predefined value; or (ii) determining an output-other-bin-value based on one or more of the other bins of the cepstrum-input-signal, and setting the pitch-bin to a predefined value.

The excitation-manipulation-block 300 of FIG. 3 is an implementation of a signal processor that can process a cepstrum-input-signal 308.

As will be appreciated from the description that follows, the excitation-manipulation-block 300 of FIG. 3 can be used as part of an a priori SNR estimation or re-synthesis schemes for speech, amongst many other applications.

Figure 4:
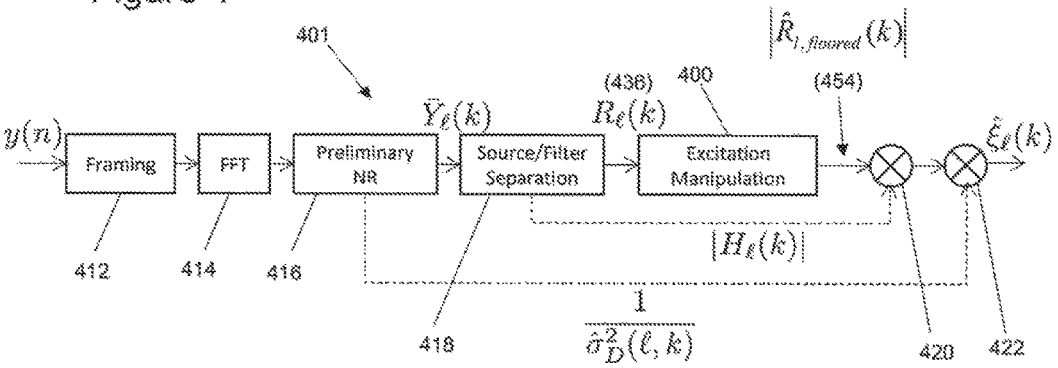
FIG. 4 shows an example embodiment of a high-level processing structure for an a priori SNR estimator, which includes an excitation-manipulation-block such as the one of FIG. 3.

FIG. 4 shows an example embodiment of a high-level processing structure for an a priori SNR estimator 401, which includes an excitation-manipulation-block 400 such as the one of FIG. 3.

The SNR estimator 401 receives a time-domain-input-signal, which in this example is a digitized microphone signal depicted as y(n) with discrete-time index n. The SNR estimator includes a framing-block 412, which processes the digitized microphone signal y(n) into frames of 16 ms with a frame shift of 50%, i.e., 8 ms. Each frame with frame index l is transformed into the frequency-domain by a fast Fourier transform (FFT) block 414 of size K. In some examples, sampling rates of 8 kHz and 16 kHz can be used. Example sizes of the DFT for these sampling rates are 256 and 512. However, it will be appreciated that any other combination of sampling rates and DFT sizes is possible.

The output terminal of the FFT block 414 is connected to an input terminal of a preliminary-noise-reduction block 416. This preliminary-noise-reduction block 416 can include a noise-power-estimation block (not shown), such as the one shown in FIG. 1. In this example, the preliminary-noise-reduction block 416 employs a minimum statistics-based estimator, as is known in the art, because it can provide sufficient robustness in non-stationary environments. However, it will be appreciated that any other noise power estimator could be used here.

Subsequently, the preliminary-noise-reduction block 416 can obtain an a-priori-SNR-value by employing a decision-directed (DD) approach, as is also known in the art. For this stage, this level of processing is considered satisfactory because the output of the preliminary-noise-reduction block 416 is an intermediate result that will not be directly experienced by the user.

The preliminary-noise-reduction block 416 employs an MMSE-LSA estimator to apply a weighting rule, as is known in the art. Again, it will be appreciated that any other spectral weighting rule could be employed here. The preliminary-noise-reduction block 416 provides as an output: a preliminary-de-noised-signal ($\ddot{Y}_l(k)$), and a noise-power-estimate-signal ($\hat{\sigma}^2_D(l,k)$).

In general, the parameterization and usage of different noise power estimators, a priori SNR estimators and weighting rules are free from any constraints. Thus, different alternatives are possible to obtain the preliminary-de-noised-signal ($\ddot{Y}_l(k)$).

The preliminary-de-noised-signal ($\ddot{Y}_l(k)$) is provided as an input signal to a source-filter-separation-block 418. As will be discussed below, the noise-power-estimate-signal ($\hat{\sigma}^2_D(l,k)$) is reused later in the SNR estimator 401 for the final a priori SNR estimation. In this example, the noise-power-estimate-signal is used in the denominator for the calculation of the a-prior-SNR-value.

The source-filter-separation-block 418 is used to separate the preliminary-de-noised-signal ($\ddot{Y}_l(k)$) Into a component-excitation-signal ($R_l(k)$) 436 and a spectral-envelope-signal ($|H_l(k)|$). These signals correspond to the excitation signal and spectral envelope that were discussed above with reference to the source-filter model of human speech production of FIG. 2.

Figure 5:
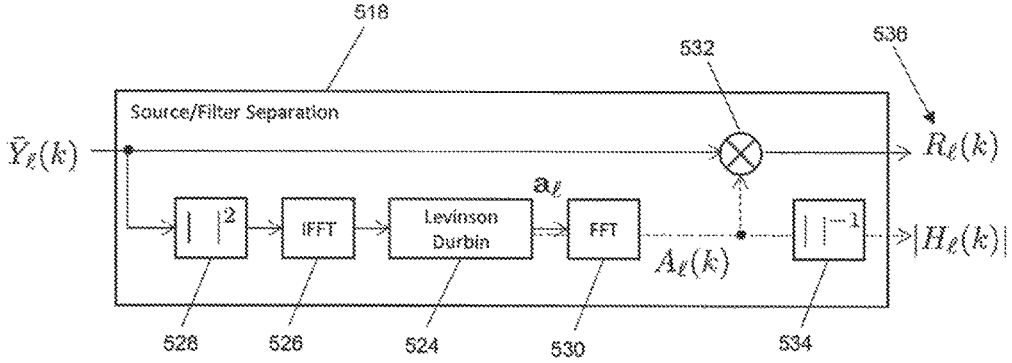
FIG. 5 shows further details of the source-filter-separation-block of FIG. 4.

FIG. 5 shows further details of the source-fitter-separation-block 518 of FIG. 4.

In order for the source-filter-separation-block 518 to determine the component-excitation-signal ($R_l(k)$) and the spectral-envelope-signal ($|H_l(k)|$), it estimates filter coefficients representing the human vocal tract.

In this example, a squared-magnitude-block 528 determines the squared magnitude of the preliminary-de-noised-signal ($\ddot{Y}_l(k)$) in order to provide a squared-magnitude-spectrum-signal. An inverse fast Fourier transform (IFFT) block 526 then converts the squared-magnitude-spectrum-signal into the time-domain in order to provide a squared-magnitude-time-domain-signal. The squared-magnitude-time-domain-signal is representative of autocorrelation coefficients of the preliminary-de-noised-signal ($\ddot{Y}_l(k)$). An alternative approach (not shown) is to calculate the autocorrelation coefficients in the time-domain.

A Levinson-Durbin block 524 then applies a Levinson-Durbin algorithm to the squared-magnitude-time-domain-signal in order to generate estimated values for $N_P+1$ time-domain-filter coefficients contained in vector $a_l$ on the basis of the autocorrelation coefficients. These coefficients represent an autoregressive modelling of the signal.

The $N_P+1$ time-domain-filter-coefficients $a_l$ generated by the Levinson-Durbin algorithm 524 are subsequently processed by another FFT block 530 in order to generate a frequency-domain representation of the filter-coefficients ($A_l(k)$). The frequency-domain representation of the filter-coefficients ($A_l(k)$) are then multiplied by the preliminary-de-noised-signal ($\ddot{Y}_l(k)$) in order to provide the excitation signal $R_l(k)$. The corresponding spectral-envelope-signal ($|H_l(k)|$) is provided by an inverse-processing-block 534 that calculates the inverse of the filter-coefficients ($A_l k$)).

It will be appreciated that the Levinson-Durbin algorithm is just one example of an approach for obtaining the coefficients of the filter describing the vocal tract. In principle, any method to separate a signal into its constituent excitation and envelope components is applicable here.

Returning to FIG. 4, the component-excitation-signal ($R_l(k)$) 436 generated by the source-filter-separation-block 418 is provided as an input signal to the excitation-manipulation-block 400. The output of the excitation-manipulation-block 400 is a manipulated-output-signal $|\hat{R}_{l,floored}(k)|$ 454, which in this example has an enhanced speech component and reduced noise.

It will be appreciated that this pre-processing, before the excitation-manipulation-block 400, is just one example of a processing structure, and that alternative structures can be used, as appropriate.

Figure 6:
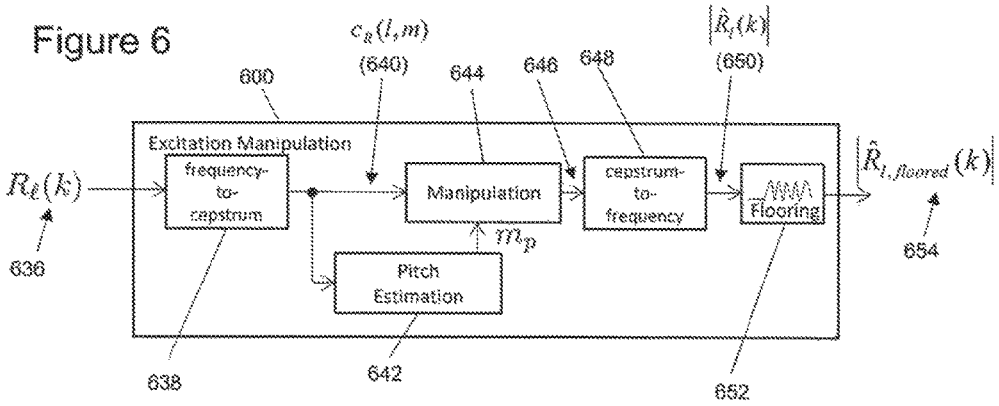
FIG. 6 shows an example embodiment of an excitation-manipulation-block 600, which can be used in FIG. 4.

FIG. 6 shows an example embodiment of an excitation-manipulation-block 600, which can be used in FIG. 4.

The excitation-manipulation-block 600 receives the component-excitation-signal ($R_l(k)$) 636, which is an example of a frequency-input-signal. A frequency-to-cepstrum-block 638 converts the component-excitation-signal ($R_l(k)$) 636 into a cepstrum-input-signal ($c_R(l,m)$) 640, which is in the cepstrum domain.

In this example the frequency-to-cepstrum-block 638: calculates the absolute values of the component-excitation-signal ($R_l(k)$) 636, then calculates the log of the absolute values, and then performs a discrete cosine transform of type II (DCTII). In this way, the frequency-to-cepstrum-block 638 of this example applies the following formula:

$$c_R(\ell, m) = \sum_{k=0}^{K-1} \log(|R_\ell(k)|) \cdot \cos\left[\pi m(k+0.5)\frac{1}{K}\right]$$

Wherein:

K is the size of the transform, l represents the current frame being processed, k represents the discrete frequency index of the spectrum obtained from the DFT on the time-domain signal. This is used to denote a particular frequency bin in the spectrum, and m is the cepstral bin index, used to denote a particular cepstral bin after transformation into the cepstrum.

In an alternative example, the transform in the frequency-to-cepstrum-block 638 may be implemented by an IDFT block. This is an alternative block that can provide cepstral coefficients. In general, any transformation that analyses the spectral representation of a signal in terms of wave decomposition can be used.

In this example the cepstrum-input-signal ($c_R(l,m)$) 640 can be considered as a current preliminary de-noised frame's cepstral representation of the excitation signal. The next step is to identify the pitch value of the cepstrum-input-signal ($c_R(l,m)$) 640 using a pitch-estimation-block 642. The pitch-estimation-block 642 may be provided as part of, or separate from, the excitation-manipulation-block 600. That is, pitch information may be received from an external source.

The output of the pitch-estimation-block 642 is a pitch-bin-identifier ($m_p$) that is indicative of a pitch-bin in the cepstrum-input-signal ($c_R(l,m)$) 640; that is the cepstral bin of the signal that is expected to contain the information that corresponds to the pitch of the excitation signal. The pitch-estimation-block 642 can determine an amplitude of a plurality of the bins in the cepstrum-input-signal ($c_R(l,m)$) 640, and determine the bin-index that has the highest amplitude, within a specific pre-defined range, as the pitch-bin.

In some examples, the pitch-estimation-block 642 can determine the amplitude of all of the bins in the cepstrum-input-signal ($c_R(l,m)$) 640.

In this example, the pitch-estimation-block 642 determines the amplitude of only a subset of the bins in the cepstrum-input-signal ($c_R(l,m)$) 640. The scope of possible pitch values is narrowed to values greater than a lower-frequency-value of 50 Hz, and less than an upper-frequency-value of 500 Hz. According to the following formula, the pitch-estimation-block 642 calculates the corresponding boundaries of the capstral bin-index/coefficient (m):

$$m = \text{integer}\left(\frac{2f_s}{f}\right)$$

Where integer( ) is an operator that may implement the floor (round down) or ceil (round up) or a standard rounding function. The sample frequency is described by $f_s$, and the frequency of interest by f. Since the DCTII block 638 yields a spectrum with double-time resolution, a factor of two is introduced into the above formula.

For a sampling frequency of 8 kHz, the lower-frequency-value of 50 Hz corresponds to an upper-cepstral-bin-index of 320, and the upper-frequency-value of 500 Hz corresponds to a lower-cepstral-bin-index of 32.

The pitch-estimation-block 642 then identifies the pitch-bin-identifier ($m_p$) as the bin-index that is between the upper-cepstral-bin-index of 320 and the lower-cepstral-bin-index of 32 that has the highest value/amplitude. Mathematically this is equal to the following operation:

$$m_p = \underset{\mu}{\operatorname{argmax}}(c_R(f, \mu))$$

$$\text{with } m_{500} \le \mu \le m_{50},\ m_{50} = 320, \text{ and } m_{500} = 32.$$

This is one example of an implementation to obtain a pitch estimate. In general, any state-of-the-art pitch estimation method will suffice. In the particular embodiment where a set of pitch-bin-identifiers is calculated, also multiples of $m_p$ such as 2 $m_p$ and 3 $m_p$ and/or values very close (for example within a predefined number of bins from $m_p$ or a multiple of $m_p$) to these can be part of the set.

The pitch-bin-identifier ($m_p$) and the cepstrum-input-signal ($c_R(l,m)$) 640 are provided as inputs to a signal-manipulation-block 644. The cepstrum-input-signal ($c_R(l,m)$) 640 has a zeroth-bin, one or more pitch-bins as defined by the pitch-bin-identifier ($m_p$) or a set of pitch-bin-identifiers, and other-bins that are not the zeroth bin or the (set of) pitch-bin(s).

As an initialization step, the signal-manipulation-block 644 defines an empty-cepstral-vector as a manipulation-vector for which the other-bins are set to zero:

$$C_R(l,m)=0\ \forall m \notin \{0, m_p\}.$$

Then, the signal-manipulation-block 644 inserts the values of the cepstrum-input-signal ($c_R(l,m)$) 640 at the zeroth coefficient (zeroth-bin), and the coefficient found by the pitch search (the pitch-bin-identifier ($m_p$)) into the manipulation-vector while the remainder of the cepstral vector remains zero:

$$c_R(l,m)=c_R(l,m)\forall m \in \{0, m_p\}.$$

In this way, the signal-manipulation-block 644 generates a cepstrum-output-signal 646 by scaling the pitch-bin relative to one or more of the other bins of the cepstrum-input-signal, this is because a scaling-factor of 1 is applied to the pitch-bin (at least at this stage in the processing) and a scaling-factor of 0 is applied to the other-bins. This can also be considered as setting the values of the other-bins to a predefined value of zero whilst determining an output-pitch-bin-value based on the pitch-bin. In this example, the signal-manipulation-block 644 also determines an output-zeroth-bin-value based on the zeroth-bin of the cepstrum-input-signal.

In the particular embodiment where a set of pitch-bin-identifiers is computed, the cepstrum-input-signal of all of the related pitch-bins will be inserted in the manner as shown above.

A yet further way of considering the above functionality is that the signal-manipulation-block 644 retains the zeroth bin and the pitch-bin of the cepstrum-input-signal ($c_R(l,m)$) 640, and attenuates one or more of the other-bins of the cepstrum-input-signal ($c_R(l,m)$) 640—in this example by attenuating them to zero. That is, a pitch-bin-scaling-factor of 1 is applied to the pitch-bin of the cepstrum-input-signal, a zeroth-bin-scaling-factor of 1 is applied to the zeroth-bin of the cepstrum-input-signal, and an other-bin-scaling-factor of 0 is applied to the other bins of the cepstrum-input-signal.

More generally, the other-bin-scaling-factor can be different to the pitch-bin-scaling-factor. For example, the other-bin-scaling-factor can be less than the pitch-bin-scaling-factor in order to emphasize speech. Alternatively, the other-bin-scaling-factor can be greater than the pitch-bin-scaling-factor in order to de-emphasize speech, thereby emphasizing noise components.

The signal-manipulation-block 644 may generate the cepstrum-output-signal based on the cepstrum-input-signal by: (i) retaining the pitch-bin of the cepstrum-input-signal, and attenuating one or more of the other bins of the cepstrum-input-signal; or (ii) attenuating the pitch-bin of the cepstrum-input-signal, and retaining one or more of the other bins of the cepstrum-input-signal. "Retaining" a bin of the cepstrum-input-signal may comprise: maintaining the bin un-amended, or multiplying the bin by a scaling factor that is greater than one. Attenuating a bin of the cepstrum-input-signal may comprise multiplying the bin by a scaling factor that is less than one.

In further embodiments still, unequal scaling-offsets can be added to, or subtracted from, one or more of the pitch-bin, zeroth-bin and other-bins in order to generate a cepstrum-output-signal in which the pitch-bin has been scaled relative to one or more of the other bins of the cepstrum-input-signal. For example, a pitch-bin-scaling-offset may be added to the pitch-bin of the cepstrum-input-signal, and an other-bin-scaling-offset may be added to one or more of the other bins of the cepstrum-input-signal, wherein the other-bin-scaling-offset is different to the pitch-bin-scaling-offset. One of the other-bin-scaling-offset and the pitch-bin-scaling-offset may be equal to zero.

The excitation-manipulation-block 600 also includes a cepstrum-to-frequency-block 648 that receives the cepstrum-output-signal 646 and determines a frequency-output-signal 650 based on the cepstrum-output-signal 646. The frequency-output-signal 650 is in the frequency-domain.

In this example the cepstrum-to-frequency-block 648 calculates the exponent value of the frequency-output-signal ($|\hat{R}_l(k)|$) 650, and then performs an inverse discrete cosine transform of type II (IDCTII). The cepstrum-to-frequency-block 648 therefore applies the following formula to generate the frequency-output-signal 650 ($|\hat{R}_l(k)|$)

$$|\hat{R}_\ell(k)| = \exp\left(\frac{c_{\hat{R}}(\ell, 0)}{K} + \frac{2}{K}\sum_{m=1}^{K-1} c_{\hat{R}}(\ell, m)\cdot\cos\left[\pi m(k+0.5)\frac{1}{K}\right]\right),$$

In this way, the frequency-output-signal 650 ($|\hat{R}_l(k)|$) includes a cosine with the peaks at the pitch frequency, and corresponding harmonics.

Figure 7:
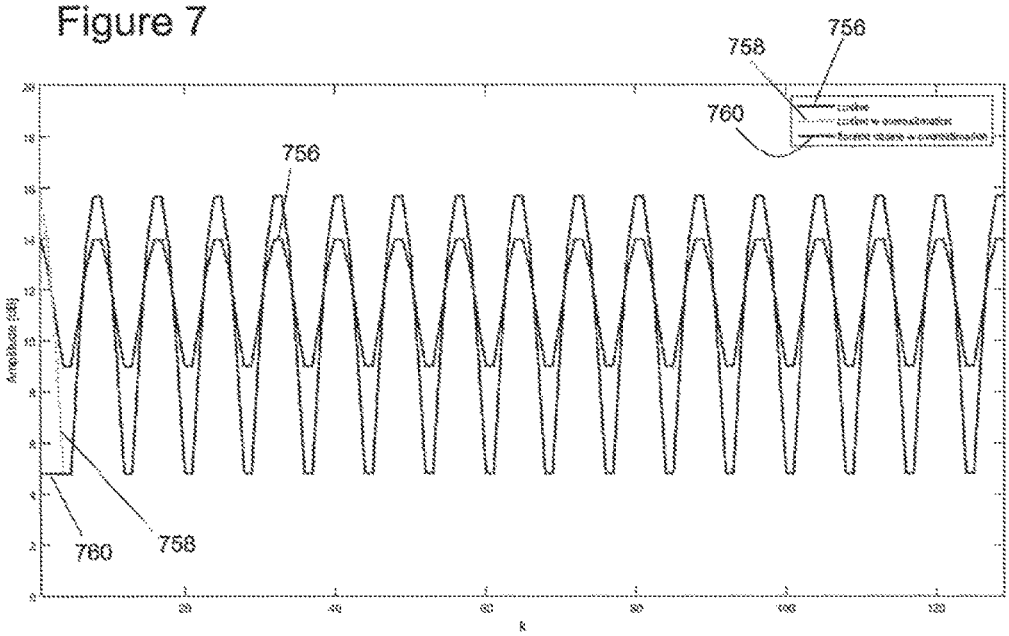
FIG. 7 shows graphically some of the signals in FIG. 6.

FIG. 7 shows graphically, with reference 756, the frequency-output-signal 650 ($|\hat{R}_l(k)|$) that would be output by the IDCTII block 648 based on the processing described above (that is, without an "overestimation" that will be described below). It has been found that the processing described above might result in a reconstruction of weak harmonics that are too low for use in a subsequent speech enhancement stage. Therefore, as discussed below, an overestimation factor that is greater than 1 can be applied.

Returning to FIG. 6, in some examples the excitation-manipulation-block 600 can manipulate the amplitude of the cosines in order to artificially increase them. In one example the signal-manipulation-block 644 can apply an adaptive overestimation factor $\alpha_l(m)$ to scale the cepstral coefficient (amplitude) of the pitch bin according to:

$$c_{\hat{R}}(l,m_p)=c_k(l,m_p)\cdot\alpha_l(m)$$

This can be considered as generating a cepstrum-output-signal 646 by applying a pitch-bin-scaling-factor that is greater than one to the pitch-bin.

The proposed overestimation factor $\alpha_l(m)$, which can be designed in a frame and cepstral-bin-dependent way, can be considered advantageous when compared with systems that only mix an artificially restored spectrum with a de-noised spectrum, with weights that have values between zero and one and therefore inherently do not apply any overestimation. As will be discussed below, the overestimation can yield deeper valleys in the clean speech amplitude estimate which allows better noise attenuation between harmonics and, as the peaks are raised, it is more likely that weak speech harmonics are maintained, too.

In some examples, the excitation-manipulation-block 600 can set the values of the overestimation factor $\alpha_l(m)$ based on a determined SNR value, one or more properties of the speech (for example information representative of the underlying speech envelope, or the temporal and spectral variation of the pitch frequency and amplitude), and/or one or more properties of the noise (for example information representative of the underlying noise envelope, or the fundamental frequency of the noise (if present)). Setting the values of the overestimation factor in this way can be advantageous because additional situation-relevant knowledge is incorporated into the algorithm.

FIG. 7 shows the scaled-cepstrum-output-signal with reference 758. However, the scaled-cepstrum-output-signal 758 includes a false half harmonic at the beginning of the spectrum as can be seen in FIG. 7.

Returning to FIG. 6, the excitation-manipulation-block 600 includes a flooring-block 652 that processes the frequency-output-signal 650. The flooring-block 652 can correct for the false first half harmonic by finding the first local minimum of the frequency-output-signal 650, and attenuating every spectral bin up to this point. The first local minimum of the frequency-output-signal 650 (in the frequency domain) can be found using the fundamental frequency that is identified by the pitch-bin-identifier in the cepstrum domain. In this example, the flooring-block 652 attenuates each of these spectral bins to the same value as the local minimum. The output of the flooring-block 652 is a floored-frequency-output-signal ($|\hat{R}_{l,floored}(k)|$) 654.

The flooring-block 652 can therefore attenuate one or more frequency bins in the frequency-output-signal 650 that have a frequency-bin-index that is less than a frequency-domain equivalent of the pitch-bin-identifier in order to generate the floored-frequency-output-signal ($|\hat{R}_{l,floored}(k)|$) 654. For example, the flooring-block 652 can attenuate one or more, or all of the frequency bins up to an upper-attenuation-frequency-bin-index that is based on the pitch-bin-identifier. The upper-attenuation-frequency-bin-index may be set as a proportion of the frequency-domain equivalent of the pitch-bin-identifier. The proportion may be a half, for example. Or, the upper-attenuation-frequency-bin-index may be set by subtracting an attenuation-offset-value from the frequency-domain equivalent of the pitch-bin-identifier. The attenuation-offset-value may be 1, 2 or 3 bins, as non-limiting examples.

In the particular embodiment where a set of pitch-bin-identifiers is computed, the upper-attenuation-frequency-bin-index may be based on the lowest pitch-bin-identifier of the set.

FIG. 7 shows the floored-frequency-output-signal ($|\hat{R}_{l,floored}(k)|$) with reference 760.

An advantage of using a synthesized cosine, or any other cepstral domain transformation, is that spectral harmonics can be modelled realistically using a relatively simple method.

The floored-frequency-output-signal ($|\hat{R}_{l,floored}(k)|$) 760 is a good estimation of the amplitude of the component-excitation-signal ($R_l(k)$) 636, and can be particularly well-suited for any downstream processing such as for speech enhancement. In general any method for decomposing a received signal into an envelope and (idealized) excitation can be used. In some examples it can be advantageous for, the representation of a harmonic structure to be evident, and the required manipulations to not be unduly complicated.

It will be appreciated that the flooring method described with reference to FIG. 6 is only one example implementation for attenuating the false sub-harmonic. Other methods could be used in in the cepstrum domain or in the frequency-domain. The flooring method as described can be considered advantageous because it is a simple method. Also, more sophisticated and complex methods can be used.

The flooring-block of FIG. 6 is an example of a sub-harmonic-attenuation-block, which can output a sub-harmonic-attenuated-output-signal ($|\hat{R}_{l,floored}(k)|$).

The system of FIG. 6, which includes processing in the cepstrum domain, can be considered advantageous when compared with systems that perform pitch enhancement in the time-domain signal by synthesis of Individual pitch pulses. Such time-domain synthesis can preclude frequency-specific manipulations which have been found to be particularly advantageous in speech processing.

Figure 8:
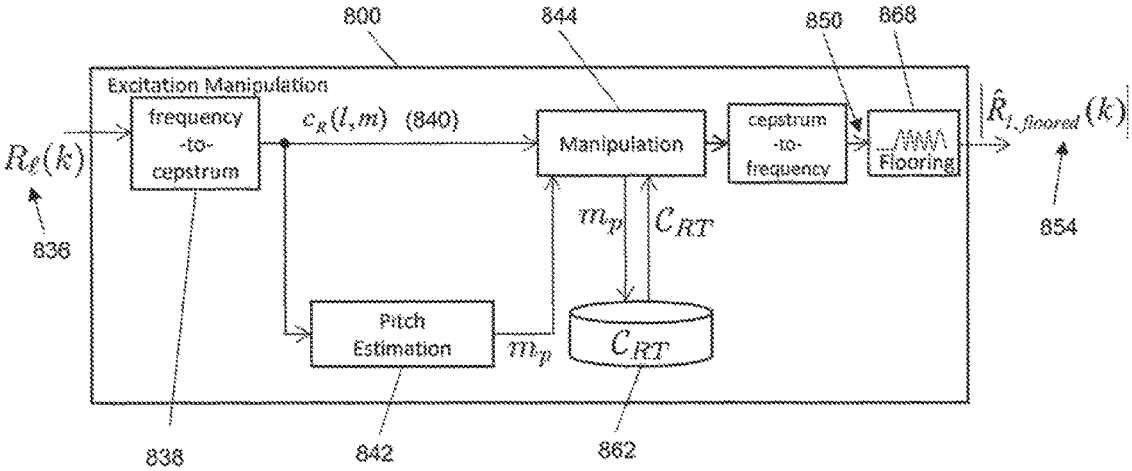
FIG. 8 shows another example embodiment of an excitation-manipulation-block 800.

FIG. 8 shows another example embodiment of an excitation-manipulation-block 800. Features of FIG. 8 that are also shown in FIG. 6 have been given corresponding reference numbers in the 800 series, and will not necessarily be described again here.

In this example, the excitation-manipulation-block 800 includes a memory 862 that stores an association between a plurality of pitch-bin-identifiers ($m_p$) and a plurality of candidate-cepstral-vectors ($C_{RT}$). Each of the candidate-cepstral-vectors ($C_{RT}$) defines a manipulation vector for the component-excitation-signal ($R_l(k)$) 836.

The signal-manipulation-block 844 receives the pitch-bin-identifier ($m_p$) from the pitch-estimation-block 842, and looks up the template-cepstral-vector (Car) in the memory 862 that is associated with the received pitch-bin-identifier ($m_p$). In this way, the signal-manipulation-block 844 determines a cepstral-vector as the candidate-cepstral-vector that is associated with the received pitch-bin-identifier ($m_p$). This cepstral-vector may be referred to as an excitation template and can include predefined other-bin-values for one or more of the other bins (that is, not the pitch-bin or set of pitch-bins) of the cepstrum-input-signal 840. In this example, the "other bins" also does not include the zeroth-bin.

The plurality of candidate-cepstral-vectors ($C_{RT}$), which may also be referred to as a set of cepstral excitation vectors for each relevant pitch value, can be expressed as:

$$C_{RT}=\{c_{RT}(m_{500}), \ldots, c_{RT}(m_p), \ldots, C_{RT}(m_{50})\}.$$

This set of candidate-cepstral-vectors ($C_{RT}$) is based on the above example, where the pitch-identifier is limited to a value between an upper-cepstral-bin-index of 320 and a lower-cepstral-bin-index of 32. Each of the candidate-cepstral-vectors ($C_{RT}$) defines a manipulation vector that includes "other-bin-values" for bins of the cepstrum-Input-signal $c_R(l, m)$ that are not the zeroth bin or the pitch-bin.

In one example, one or more of the other-bin-values in the cepstrum-output-signal are set to a predefined value such that one or more of the other bins of the cepstrum-Input-signal $c_R(l,m)$ are attenuated. In other examples, one or more of the other-bin-values may be set such that one or more of the other bins in the cepstrum-output-signal are set to a predefined value such that one or more of the other bins of the cepstrum-input-signal are amplified/increased.

Once the signal-manipulation-block 844 has retrieved the cepstral-vector according to the detected pitch value ($m_p$), the signal-manipulation-block 844 can start determining the cepstrum-output-signal by defining a manipulated cepstral vector as:

$$c_{\hat{R}}(l, m) = c_{RT,m_p}(m)$$

In this way, the candidate-cepstral-vector associated with $m_p$ is adopted as the starting point for generating the cepstrum-output-signal $C_{\hat{R}}(l,m)$.

In this example, the signal-manipulation-block 844 adjusts the energy coefficient of the manipulated cepstral vector $c_{\hat{R}}(l,m)$ since the candidate-cepstral-vectors are energy neutral. Therefore, the zeroth coefficient of the manipulated cepstral vector ($C_{\hat{R}}(l,m)$) is replaced by the zeroth cepstral coefficient of the cepstrum-input-signal (excitation signal) $c_R(l,m)$ 840, as obtained from a de-noised signal. This is because the zeroth bin of the cepstrum-input-signal is indicative of the energy of the excitation signal. In this way, the signal-manipulation-block 844 generates the cepstrum-output-signal by determining an output-zeroth-bin-value based on the zeroth-bin of the cepstrum-input-signal.

To retain the amplitude of the basic cosine of the excitation spectrum, the amplitude of the pitch-bin corresponding to the pitch of the preliminary de-noised excitation signal is multiplied by an overestimation factor $\alpha_l(m)$ in order to apply a pitch-bin-scaling-factor that is greater than one, and the resultant value is used to replace the value in the corresponding bin of the manipulated cepstral vector ($c_{\hat{R}}(l, m)$). In this way, an output-pitch-bin-value is determined based on the pitch-bin. This is similar to the previously described manipulation scheme, and can be expressed mathematically as:

$$c_{\hat{R}}(l,m)=c_R(l,m)\forall m\in\{0,m_p\}$$

$$c_{\hat{R}}(l,m_p)=c_{\hat{R}}(l,m_p)\cdot\alpha_l(m_p)$$

In contrast with the previously described manipulation scheme, in this example the other-bins (i.e. not the zeroth bin and the (set of) pitch-bin(s)) of the cepstrum-input-signal $c_R(l,m)$ 840 are not necessarily attenuated to zero, instead one or more of the bins are modified to values defined by the selected candidate-cepstral-vector ($C_{RT}$).

Figure 9:
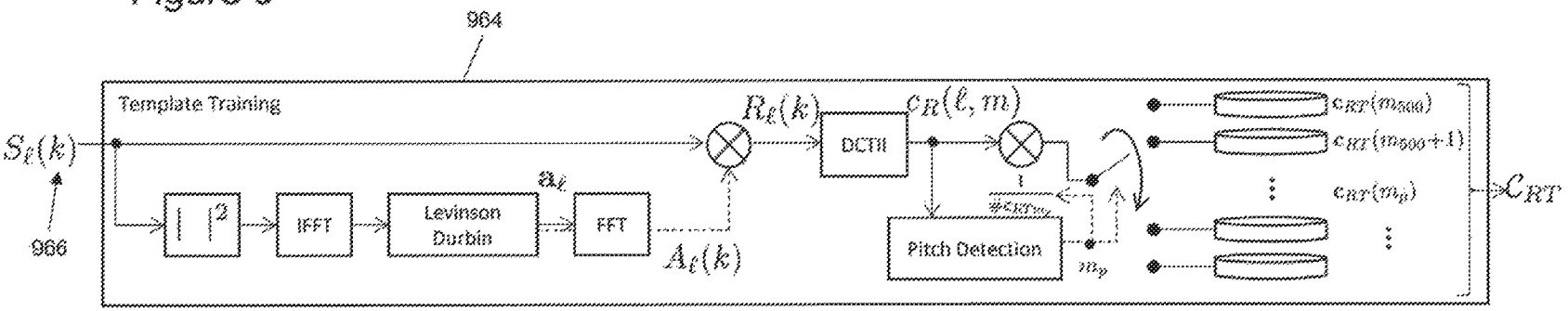
FIG. 9 shows an example template-training-block that can be used to generating the candidate-cepstral-vectors ($C_{RT}$) that are stored in the memory of FIG. 8.

FIG. 9 shows an example template-training-block 964 that can be used to generate the candidate-cepstral-vectors ($C_{RT}$) that are stored in the memory of FIG. 8.

The template-training-block 964 can generate the candidate-cepstral-vectors ($C_{RT}$) (excitation templates) for every possible pitch value. The candidate-cepstral-vectors ($C_{RT}$) are extracted by performing a source/filter separation on clean-speech-signals ($S_l(k)$) 966 and subsequently estimating the pitch. The cepstral excitation vectors are then clustered according to their pitch $m_p$ and averaged in the cepstral domain per cepstral coefficient bin.

Advantageously, the use of candidate-cepstral-vectors ($C_{RT}$) can enable a system to provide speaker dependency—that is the candidate-cepstral-vectors ($C_{RT}$) can be tailored to a particular person so that the vectors that are used will depend upon the person whose speech is being processed. For example, the candidate-cepstral-vectors ($C_{RT}$) can be updated on-the-fly, such that the candidate-cepstral-vectors ($C_{RT}$) are trained on speech signals that it processes when in use. Such functionality can be achieved by choosing the training material for the template-training-block 964 accordingly, or by performing an adaptation on person-independent templates. That is, speaker independent templates could be used to provide default starting values in some examples. Then, over time, as a person uses the device, the models would adapt these templates based on the person's speech.

Therefore, one or more of the examples disclosed herein can allow a speaker model to be introduced into the processing, which may not be inherently possible by other methods, (e.g. If a non-linearity is applied in the time-domain to obtain a continuous harmonic comb structure). In principle, different ways to obtain excitation templates and also different data structures (e.g., tree-like structures to enable a more detailed representation of different excitation signals for a certain pitch) are possible.

Returning to FIG. 8, the excitation-manipulation-block 800 includes a flooring-block 868, which can make the approach of FIG. 8 more robust towards distorted training material by applying a flooring mechanism to parts of the frequency-output-signal 850. The flooring-block 868 in this example is used attenuate low frequency noise, and not to remove a false half harmonic, as is the case with the flooring-block of FIG. 6. The flooring operation can be applied by setting appropriate values in the candidate-cepstral-vectors ($C_{RT}$) or by flooring a signal. In the specific embodiment of FIG. 8, flooring is applied to the spectrum (at the output after IDCTII block).

The schemes of both FIGS. 6 and 8 deliver a manipulated excitation signal (floored-frequency-output-signal ($|\hat{R}_{l,floored}(k)|$) which should be shaped to obtain a clean speech amplitude estimate according to a source-filter model.

Therefore, returning back to FIG. 4, the floored-frequency-output-signal ($|\hat{R}_{l,floored}(k)|$) 454 that is output by the excitation-manipulation-block 400 is mixed with the spectral-envelope-signal ($|H_l(k)|$) by a spectral-envelope-mixer 420 to generate a mixed-output-signal $|\hat{S}_l(k)|$. The amplitude spectrum of the inherent envelope ($|H_l(k)|$) of the preliminary de-noised signal is used as follows:

$$|\hat{S}_l(k)| = |\hat{R}_l(k)| \cdot |H_l(k)|$$

To receive the desired a-priori-SNR-value ($\hat{\xi}_l(k)$), the SNR estimator 401 includes an SNR-mixer 422 that squares the clean speech amplitude estimate (as represented by the mixed-output-signal $|\hat{S}_l(k)|$), and divides this squared value by the noise-power-estimate-signal ($\hat{\sigma}^2_D(l,k)$) from the preliminary-noise-reduction block 416. The functionality of the SNR-mixer 422 can be expressed mathematically as:

$$\hat{\xi}_\ell(k) = \frac{|\hat{S}_\ell(k)|^2}{\hat{\sigma}^2_D(\ell, k)}.$$

The circuits described above can be considered as beneficial when compared with an SNR estimator that simply applies a non-linearity to the enhanced speech signal $\hat{s}(n)$ in the time-domain in order to try and regenerate destroyed or attenuated harmonics. In which case the resultant signal would suffer from the regeneration of harmonics over the whole frequency axis, thus introducing a bias in the SNR estimator. One effect of this bias is the introduction of a false 'half-zeroth' harmonic prior to the fundamental frequency, which can cause the persistence of low-frequency noise when speech is present. Another effect can be the limitation of the over-estimation of the pitch frequency and its harmonics, which can limit the reconstruction of weak harmonics. This limitation can arise because an over-estimation can also potentially lead to less noise suppression in the intra-harmonic frequencies. Thus, there can be a poorer trade-off between speech preservation (preserving weak harmonics) and noise suppression (between harmonics).

Figure 10:
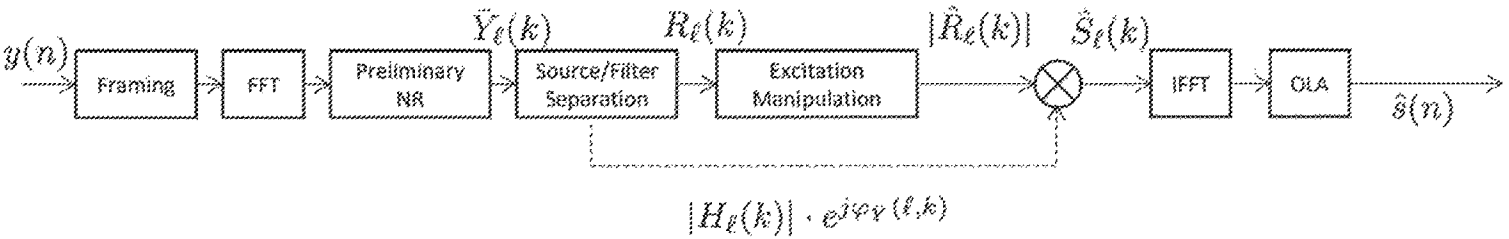
FIG. 10 shows an example speech signal synthesis system, which represents another application in which the excitation-manipulation-blocks of FIGS. 6 and 8 can be used.

FIG. 10 shows a speech signal synthesis system, which represents another application in which the excitation-manipulation-blocks of FIGS. 6 and 8 can be used. The system of FIG. 10 provides a direct reconstruction of a speech signal. In this example implementation, it will be appreciated that the spectral-envelope-signal ($|H_t(k)|$) need not necessarily be generated from a preliminary de-noised signal. Different approaches are possible where efforts are undertaken to obtain a cleaner envelope than the available one, for example, by utilizing codebooks representing clean envelopes. The directly synthesized speech signal might be used in different ways as required by every application, correspondingly. Examples are the mixing of different available speech estimates according to the estimated SNR or complete replacement of destroyed regions. The required phase information for the final signal reconstruction could be taken from the preliminary de-noised microphone signal depicted by $e^{x,y,z(l,k)}$, but again, this is just one of several possibilities. Following this, the inverse Fourier transform is computed and the time-domain enhanced signal is synthesized by e.g. the overlap-add approach.

The system of FIG. 10 can be considered as advantageous when compared with systems that rely on time-domain manipulations, this is because frequency-selective overestimation may not be straightforward for such time-domain manipulations. Also, such systems may need to rely on a very precise pitch estimation as slight deviations will be audible.

One or more of the examples discussed above utilize an understanding of human speech as an excitation signal filtered (shaped) by a spectral envelope, as illustrated in FIG. 2.

This understanding can be used to synthetically create a pitch-dependent excitation signal. This idealized excitation signal can conveniently be obtained in either the cepstral and/or the spectral domain in several ways, some of which are listed below:

- Modelling by a mathematical function, for example a cosine in the spectral domain with an optional constraint that the amplitudes at frequencies below the fundamental are artificially suppressed;
- Analysing the excitation signal using a speech database, and on this basis obtaining a pitch-dependent excitation template that can be used as a substitute for the purely mathematical model. This template could be further extended to be speaker-dependent as well.

When synthesizing the idealized excitation signal, the amplitude of the pitch and its harmonics can be easily emphasized, which reinforces the harmonic structure of the signal and ensures its preservation. By doing this emphasis in the cepstral domain, it is possible not only to emphasize the harmonic peaks, but also to ensure good intra-harmonic suppression. This may not be possible with a simple over-estimation of a scaled signal.

It will be appreciated from the above description that one or more of the circuits/blocks disclosed herein, including the excitation-manipulation-blocks of FIGS. 6 and 8, can be incorporated into any speech processing/enhancing system that would benefit from a clean speech estimate or an a priori SNR estimate. This includes, multi- or single-channel applications such as noise reduction, speech presence probability estimation, voice activity detection, intelligibility enhancement, voice conversion, speech synthesis, beamforming, means of source separation, automatic speech recognition or speaker recognition.

The instructions and/or flowchart steps in the above figures can be executed in any order, unless a specific order is explicitly stated. Also, those skilled in the art will recognize that while one example set of instructions/method has been discussed, the material in this specification can be combined in a variety of ways to yield other examples as well, and are to be understood within a context provided by this detailed description.

In some example embodiments the set of instructions/method steps described above are implemented as functional and software instructions embodied as a set of executable instructions which are effected on a computer or machine which is programmed with and controlled by said executable instructions. Such instructions are loaded for execution on a processor (such as one or more CPUs). The term processor includes microprocessors, microcontrollers, processor modules or subsystems (including one or more microprocessors or microcontrollers), or other control or computing devices. A processor can refer to a single component or to plural components.

In other examples, the set of instructions/methods illustrated herein and data and instructions associated therewith are stored in respective storage devices, which are implemented as one or more non-transient machine or computer-readable or computer-usable storage medium or media. Such computer-readable or computer usable storage medium or media is (are) considered to be part of an article (or article of manufacture). An article or article of manufacture can refer to any manufactured single component or multiple components. The non-transient machine or computer usable medium or media as defined herein excludes signals, but such medium or media may be capable of receiving and processing information from signals and/or other transient media.

Example embodiments of the material discussed in this specification can be implemented in whole or in part through network, computer, or data based devices and/or services. These may include cloud, internet, intranet, mobile, desktop, processor, look-up table, microcontroller, consumer equipment, infrastructure, or other enabling devices and services. As may be used herein and in the claims, the following non-exclusive definitions are provided.

In one example, one or more instructions or steps discussed herein are automated. The terms automated or automatically (and like variations thereof) mean controlled operation of an apparatus, system, and/or process using computers and/or mechanical/electrical devices without the necessity of human intervention, observation, effort and/or decision.

It will be appreciated that any components said to be coupled may be coupled or connected either directly or indirectly. In the case of indirect coupling, additional components may be located between the two components that are said to be coupled.

In this specification, example embodiments have been presented in terms of a selected set of details. However, a person of ordinary skill in the art would understand that many other example embodiments may be practiced which include a different selected set of these details. It is intended that the following claims cover all possible example embodiments.

The invention claimed is:

1. A signal processor comprising:

a pitch-estimation-block configured to receive a cepstrum-input-signal representative of a noisy speech signal, determine an amplitude of a plurality of bins in the cepstrum-input-signal, and determine that a bin with a highest amplitude is the pitch-bin;

a signal-manipulation-block configured to receive the cepstrum-input-signal, receive a pitch-bin-identifier that is indicative of the pitch-bin in the cepstrum-input-signal, and generate a cepstrum-output-signal based on the cepstrum-input-signal by multiplying an amplitude of the pitch-bin with an overestimation factor corresponding to a pitch-bin-scaling-factor that is greater than one relative to one or more of the other bins of the cepstrum-input-signal;

a frequency-to-cepstrum-block configured to receive a frequency-input-signal and determine the cepstrum-input-signal based on the frequency-input-signal;

a cepstrum-to-frequency-block configured to receive the cepstrum-output-signal; and determine a frequency-output-signal based on the cepstrum-output-signal; and a sub-harmonic-attenuation-block configured to attenuate one or more frequency bins in the frequency-output-signal that have a frequency-bin-index that is less than a frequency-domain equivalent of the pitch-bin-identifier to generate a sub-harmonic-attenuated-output-signal;

wherein the sub-harmonic-attenuation-block is configured to find a first local minimum of the frequency-output-signal.

2. The signal processor of claim 1, wherein the signal-manipulation-block is configured to generate the cepstrum-output-signal by determining an output-zeroth-bin-value based on a zeroth-bin of the cepstrum-input-signal.

3. The signal processor of claim 1, wherein the signal-manipulation-block is configured to scale the pitch-bin relative to the one or more of the other bins of the cepstrum-input-signal by applying a pitch-bin-scaling-factor to the pitch-bin of the cepstrum-input-signal and applying an other-bin-scaling-factor to one or more of the other bins of the cepstrum-input-signal; wherein the other-bin-scaling-factor is different to the pitch-bin-scaling-factor.

4. The signal processor of claim 1, wherein the signal-manipulation-block is configured to scale the pitch-bin relative to the one or more of the other bins of the cepstrum-input-signal by applying a pitch-bin-scaling-offset to the pitch-bin of the cepstrum-input-signal and applying an other-bin-scaling-offset to one or more of the other bins of the cepstrum-input-signal; wherein the other-bin-scaling-offset is different to the pitch-bin-scaling-offset.

5. The signal processor of claim 1, wherein the pitch-bin-identifier is indicative of a plurality of pitch-bins that are representative of a fundamental frequency.

6. The signal processor of claim 1, wherein the signal-manipulation-block is configured to generate the cepstrum-output-signal by setting the amplitude of one or more of the other bins of the cepstrum-input-signal to zero.

7. The signal processor of claim 1, further comprising:

a memory configured to store an association between a plurality of pitch-bin-identifiers and a plurality of candidate-cepstral-vectors, wherein each of the candidate-cepstral-vectors defines a manipulation vector for the cepstrum-input-signal; and the signal-manipulation-block is configured to: determine a selected-cepstral-vector as the candidate-cepstral-vector that is stored in the memory associated with the received pitch-bin-identifier; and generate the cepstrum-output-signal by applying the selected-cepstral-vector to the cepstrum-input-signal.

8. The signal processor of claim 7, wherein the candidate-cepstral-vectors define a manipulation vector that includes predefined other-bin-values for one or more bins of the cepstrum-input-signal that are not the pitch-bin.

9. The signal processor of claim 7, wherein the plurality of candidate-cepstral-vectors are associated with speech components from a specific user.

10. The signal processor of claim 1, wherein the pitch-estimation-block is configured to determine an amplitude of a plurality of the bins in the cepstrum-input-signal that have a bin-index that is between an upper-cepstral-bin-index and a lower-cepstral-bin-index.

11. The signal processor of claim 1, wherein the sub-harmonic-attenuation-block is configured to attenuate a false first half harmonic in the frequency-output-signal.

12. A speech processing system including the signal processor of claim 1.

13. A signal processor comprising:

a pitch-estimation-block configured to receive a cepstrum-input-signal representative of a noisy speech signal, determine an amplitude of a plurality of bins in the cepstrum-input-signal, and determine that a bin with a highest amplitude is the pitch-bin;

a signal-manipulation-block configured to receive the cepstrum-input-signal, receive a pitch-bin-identifier that is indicative of the pitch-bin in the cepstrum-input-signal, and generate a cepstrum-output-signal based on the cepstrum-input-signal by multiplying an amplitude of the pitch-bin with an overestimation factor corresponding to a pitch-bin-scaling-factor that is greater than one relative to one or more of the other bins of the cepstrum-input-signal;

a frequency-to-cepstrum-block configured to receive a frequency-input-signal and determine the cepstrum-input-signal based on the frequency-input-signal;

a cepstrum-to-frequency-block configured to receive the cepstrum-output-signal; and determine a frequency-output-signal based on the cepstrum-output-signal; and a sub-harmonic-attenuation-block configured to attenuate one or more frequency bins in the frequency-output-signal that have a frequency-bin-index that is less than a frequency-domain equivalent of the pitch-bin-identifier to generate a sub-harmonic-attenuated-output-signal;

wherein the sub-harmonic-attenuation-block is configured to attenuate a false first half harmonic in the frequency-output-signal.

* * * * *